US005655312A

United States Patent [19]

Sevcik

[11] Patent Number: 5,655,312

[45] Date of Patent: Aug. 12, 1997

[54] UV CURING/DRYING APPARATUS WITH INTERLOCK

[75] Inventor: Edward Scott Sevcik, Carol Stream, Ill.

[73] Assignee: Fusion UV Systems, Inc., Rockville, Md.

[21] Appl. No.: 537,509

[22] Filed: Oct. 2, 1995

[51] Int. Cl.[6] ..... F26B 3/34

[52] U.S. Cl. ..... 34/275; 34/277; 34/535; 34/61; 34/68; 34/87

[58] Field of Search ..... 34/275, 277, 524, 34/526, 535, 61, 67, 68, 87

[56] References Cited

U.S. PATENT DOCUMENTS

| | | | |
|---|---|---|---|
| 3,829,982 | 8/1974 | Pray | 34/277 |
| 3,935,330 | 1/1976 | Smith et al. | 427/41 |
| 3,991,484 | 11/1976 | Lamb et al. | 34/659 |
| 4,037,329 | 7/1977 | Wallace | 34/277 |
| 4,408,400 | 10/1983 | Colapinto | 34/278 |
| 4,442,611 | 4/1984 | Gunther et al. | 34/266 |
| 4,882,853 | 11/1989 | Schaft | 34/68 |
| 5,035,066 | 7/1991 | Wimberger | 34/641 |
| 5,129,161 | 7/1992 | Szarka | 34/277 |
| 5,134,788 | 8/1992 | Stibbe et al. | 34/524 |
| 5,369,892 | 12/1994 | Dhaemers | 34/275 |

*Primary Examiner*—John M. Sollecito
*Assistant Examiner*—Steve Gravini
*Attorney, Agent, or Firm*—Pollock, Vande Sande & Priddy

[57] ABSTRACT

An apparatus including both an ultraviolet curing unit and a hot air dryer, either one of which may be operated at a given time. A wall of the dryer has an opening through which the ultraviolet radiation emitted by the curing unit passes when the curing unit is activated. A moveable slide plate covers the opening when the dryer is activated, creating the proper hot air dryer chamber volume for effective dryer operation.

8 Claims, 3 Drawing Sheets

UV CURING/DRYING APPARATUS WITH INTERLOCK

The present application is directed to an apparatus including an ultraviolet curing unit and a hot air dryer, for treating inks or coatings, in which either the ultraviolet curing unit or the hot air dryer is capable of being operated at a given time.

The application of inks and coatings to substrates or articles is a widely practiced art. Historically, a common way of drying such inks or coatings has been with the use of a hot air dryer. However, in more recent years, the use of ultraviolet curing units to cure photocurable inks and coatings has become more frequent. Advantages of ultraviolet curing are that it is more energy efficient, and is pollution-free in that the photocurable inks are alcohol free and thus do not release volatile organic compounds into the environment. Additionally, ultraviolet curing avoids the use of gas, which is sometimes used in hot air drying.

For this and other reasons, many companies have converted from the use of hot air dryers to ultraviolet technology. However, in some cases, companies which may be in the process of such conversion, may desire to have both modalities available in the same equipment so that ultraviolet curing may be used for some processes, while hot air drying would be used for others.

It is necessary in many cases for the curing/drying apparatus to be as compact as possible. This is because in many process lines which employ such equipment, space is limited. For example, it may be desirable for the apparatus to be located within the frame of a narrow web printing press, which places a particularly rigid constraint upon space.

In the prior art, apparatus offering both ultraviolet curing or hot air drying so that either could be selected for a given process was known. However, in such apparatus, in order to achieve a compact structure, the size of the hot air tunnel was reduced. This adversely affected the efficiency of the hot air drying.

It is therefore an object of the present invention to provide an apparatus which includes both an ultraviolet curing unit and a hot air dryer.

It is a further object of the invention to provide an apparatus of the above-mentioned type which contains an interlock so as to preclude the ultraviolet curing unit and hot air dryer from being operated at the same time.

It is still a further object of the invention to provide a compact apparatus of the above-mentioned type in which the size of the hot air tunnel is not reduced.

In accordance with the invention, an apparatus is provided which is capable of performing either ultraviolet curing or hot air drying of an ink or coating on a surface, comprising,

- a hot air dryer including a hot air chamber having a wall which includes an opening,
- an ultraviolet curing unit located so that ultraviolet radiation emitted from the unit passes through the opening and onto an ink or coating on the surface when the ultraviolet curing unit is activated,
- a cover for the opening which is movable from a first position where it does not cover the opening when the curing unit is activated to a second position where it does cover the opening when the dryer is activated, and
- means for causing hot air to pass out of the chamber and onto the ink or coating on the surface when the hot air dryer is activated.

The invention will be better understood by referring to the accompanying drawings, wherein.

Figure 2:
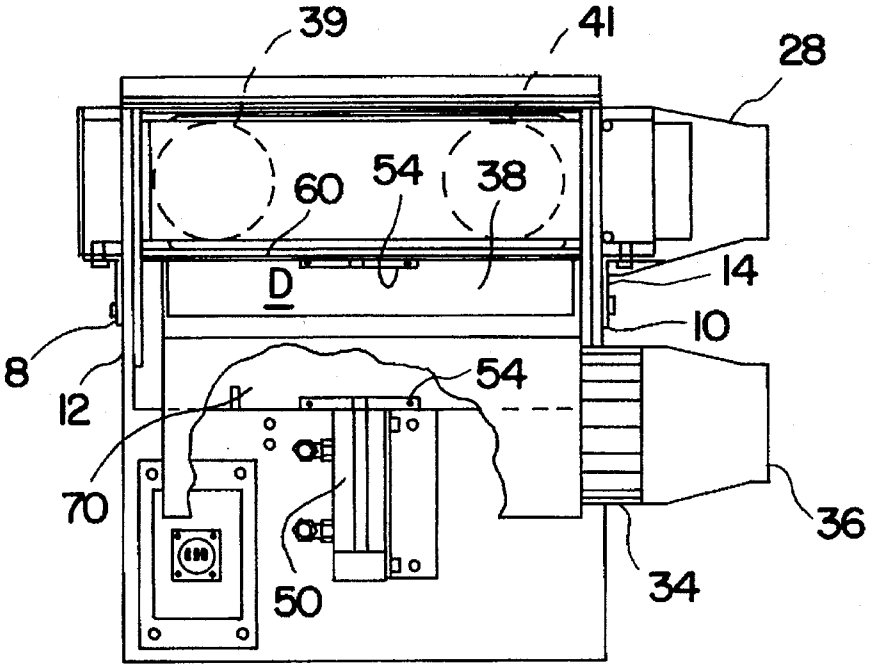
FIG. 2 is a top view of the apparatus of FIG. 1.
Figure 1:
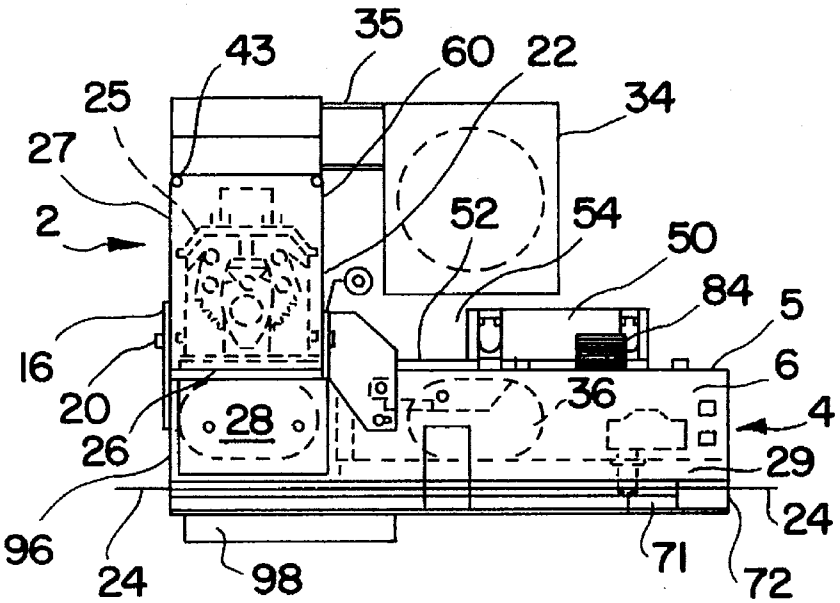
FIG. 1 is a front view of an apparatus in accordance with an embodiment of the invention.

Referring to FIG. 1, a composite apparatus which incorporates UV curing unit 2 and hot air dryer 4 is shown. The hot air dryer includes rectangular box 5 having hot air chamber 6 therein, which is also a rectangular box. As shown in FIGS. 1 and 2, the UV curing unit 2 is attached to the side walls 8 and 10 of the box 5 with angle brackets 12 and 14.

The UV curing unit 2 includes linear lamp bulb 16, which in the preferred embodiment is an arc lamp, although the invention may also be used with electrodeless bulbs. A focussing reflector such as an elliptical or parabolic reflector is provided. Referring to FIG. 1, an elliptical reflector is comprised of two portions 20 and 22 which are moveable between open and dosed positions. When open, they are effective to focus the light from bulb 16 on a focal plane located at web 24, which bears the ink or coating to be cured, and when closed (as shown in FIG. 1), they are effective to block the light from the bulb. The bulb and reflector structure is secured to mounting means 25, which slides in and out of box 27.

The top wall 26 of dryer box 5 has a rectangular opening in it at a position directly under bulb 16. Thus, ultraviolet radiation from bulb 16 passes through the opening when the UV curing unit is activated, and the radiation is incident on web 24. Dryer exhaust 28, which is shown in the front view of FIG. 1 is offset from the rectangular opening, and thus does not block the UV radiation (see FIG. 2).

Figure 4:
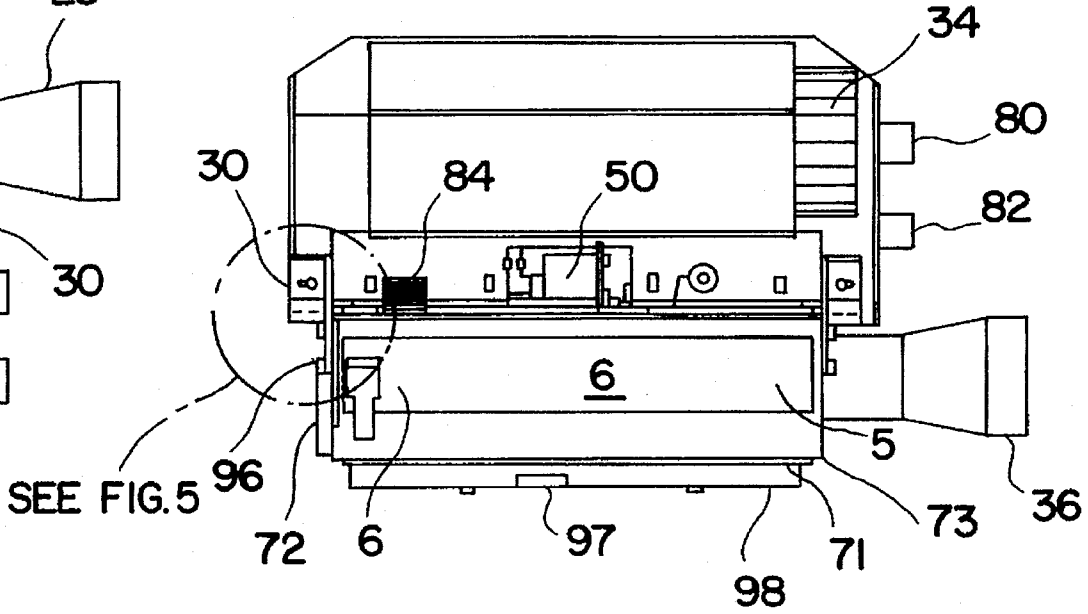
FIGS. 3 and 4 are side views.
Figure 3:
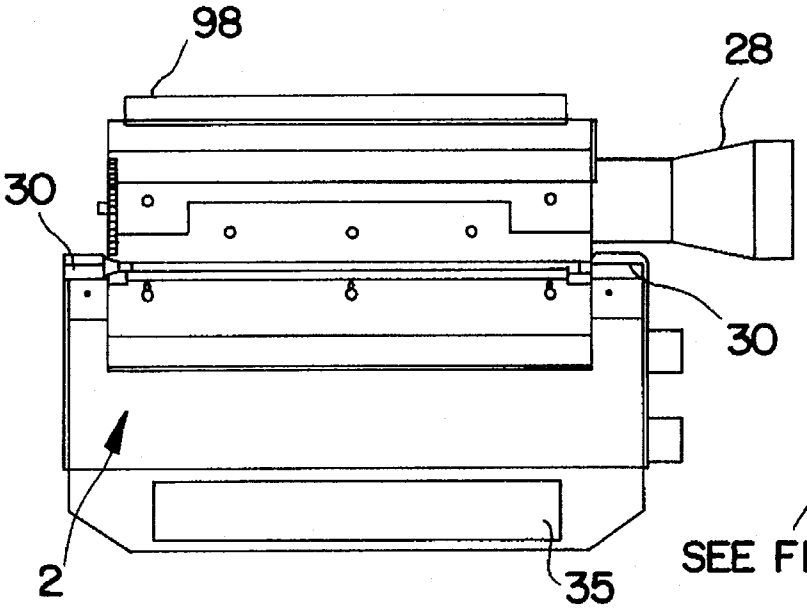
Figure 5:
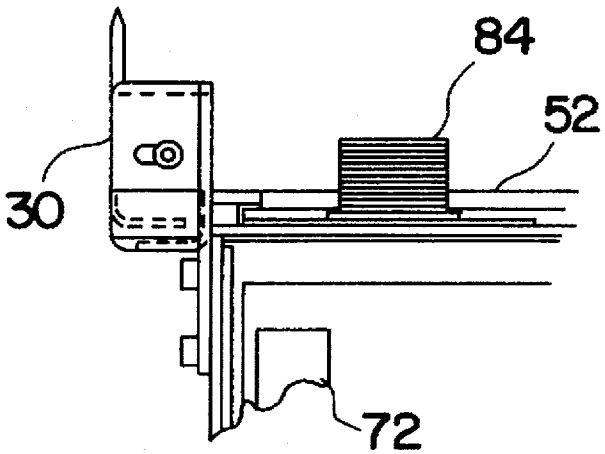
FIG. 5 is a detail of area B of FIG. 4.

Lamp 16 is air cooled, and the air intake 30 is depicted in FIG. 4 and in greater detail in FIG. 5. The air is drawn into the lamp by a negative pressure created by a remotely located exhaust blower, and after cooling the bulb and reflector, passes out of the unit through holes 39 and 41 (FIG. 2) in curing unit top member 43, which are connected to exhaust duct 34 by conduit 35 shown in FIG. 1.

The hot air dryer includes hot air chamber 6, hot air intake 36, exhaust plenum 38 (FIG. 2), and exhaust outlet 28. Hot air is provided by the user of the apparatus, typically by gas or electric heating, and is fed to intake 36. The bottom of the hot air chamber 6 is a perforated metal panel 29, and hot air is emitted through the, perforations onto web 24 for the purpose of drying an ink or coating on the web. After performing this function, the hot air enters exhaust plenum 38 and is emitted from exhaust outlet 28.

The dryer will operate effectively only if the hot air chamber pressure falls within a certain range. As mentioned above, the top 26 of the dryer has a rectangular opening therein. As long as this opening is not closed, the required pressure does not exist, and the dryer cannot operate effectively. Thus, the dryer does not operate when the UV curing unit is activated since the rectangular opening remains open when the UV curing unit is activated to allow UV radiation to be incident on the web.

When it is desired to use the hot air dryer instead of the UV curing unit, an electrical switch on a control panel is thrown. This activates air cylinder 50 shown in FIGS. 1, 2, and 4. A slide plate is comprised of horizontal member 52 and vertical member 54, and is made of one piece or two pieces which are joined together. Horizontal member 52 is rectangular, and is slightly larger than the rectangular opening in the top wall 26. The air cylinder pushes the slide plate to the left in FIG. 1, until vertical member 54 is flush against side wall 60 of the UV curing unit. This is also depicted in FIG. 2, where the slide plate is shown both in position C, and in position D where it is flush against side wall 60. In the preferred embodiment, the slide plate is made of teflon.

When vertical member 54 is flush against side wall 60, horizontal member 52 covers the rectangular opening in top wall 26. Thus, the slide plate comprises a cover for the rectangular opening, and with such cover in place, the required chamber volume and pressure for hot air dryer operation are provided.

Thus, it is seen that an extremely compact arrangement is provided wherein the UV curing unit is located over the hot air dryer, and a coverable opening is provided in the dryer with a slide plate functioning as a moveable cover and being switched between positions depending on whether UV curing or hot air drying operation is desired. A further advantage of the present invention is that the UV lamp is covered when the hot air dryer is activated, thus protecting the bulb and reflector from contaminant particles resulting from the drying operation.

When vertical member 54 is in the position shown in FIG. 1, it engages microswitch 70. This microswitch must be engaged for the UV curing unit to operate, thus ensuring that it doesn't operate when the rectangular opening is covered.

The dryer box 5 includes a door 71 which is hinged at 73 to open so as to gain access to the web being treated. There is a further microswitch 72 which is engaged when the door is dosed to permit UV lamp operation, thus ensuring that the lamp won't operate when the door is open so as to protect personnel who may be accessing the web from being burned by the lamp radiation. Microswitches 70 and 72 are connected in series so that both conditions must be present for the lamp to turn on.

Electrical connector 80 is for connecting apparatus for providing control voltages including those for inner lamp module interlock, temperature switch, shutter activation switch, while connector 82 is for supplying the high voltage for operating the lamp. Connector 84 is for the control voltages for microswitches 70 and 72.

Figure 6:
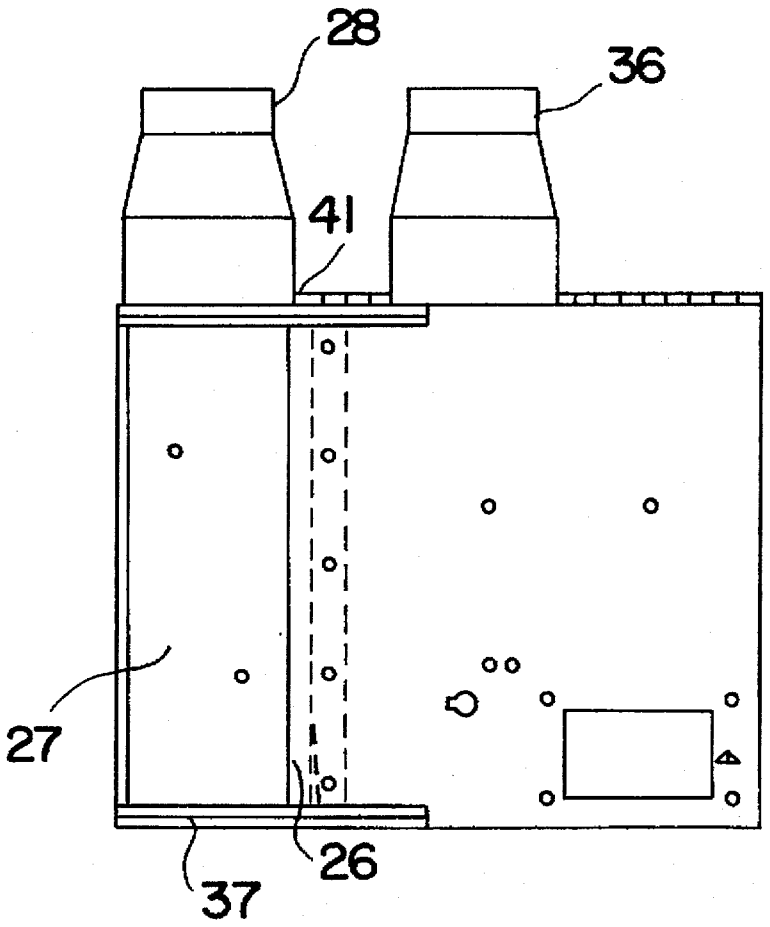
FIG. 6 is a top view showing an opening in the top dryer wall through which UV radiation passes.

FIG. 6 is a top view of the dryer top wall 26 under the UV lamp, and shows the rectangular opening 27 which is covered or uncovered depending on whether UV curing or hot air drying is desired. Each of elongated members 37 and 41 in FIG. 6 includes a channel in which the slide plate 52 moves as it covers or uncovers opening 27.

In the operation of the apparatus, switch means controlled by an operator determines whether the UV curing unit or the hot air dryer is activated. In the case where the UV curing unit is activated, slide plate 52, 54 is in the position shown in FIG. 1, microswitch 71 is engaged, power is supplied to lamp 16, rectangular opening 27 is not covered, and the substrate is illuminated with ultraviolet radiation. Conversely, in the case where the hot air dryer is activated, slide plate 52, 54 covers opening 27, microswitch 71 is not engaged, hot air is fed to chamber 6, where it is at the correct pressure for dryer operation, and hot air is fed through perforations in the bottom panel of chamber 6, and onto the web 24.

Heat shield 96 protects the wall of hot air chamber 6 from UV radiation. This shield is present only beyond the end of the UV lamp at the opposite end from exhaust 28, and thus does not obscure UV radiation. Insulation pocket 97 which may be made of fiberglass-like material is located in chamber 98 attached to door 71, and is for absorbing excess heat.

It should be understood that while the invention has been illustrated in connection with specific embodiments, variations will occur to those skilled in the art, and the scope of the invention is to be limited only by the claims which are appended hereto and equivalents.

I claim:

1. An apparatus which is capable of providing either ultraviolet curing or hot air drying of an ink or coating on a substrate, comprising, an ultraviolet curing unit, a hot air dryer having a hot air chamber which is required to have a volume within a certain range to render said hot air dryer operable, and means for rendering said hot air dryer inoperable by controlling said volume so that it is outside of said predetermined range when said ultraviolet curing unit is activated thereby preventing simultaneous operation of said hot air dryer and said ultraviolet curing unit.

2. An apparatus which is capable of performing either ultraviolet curing or hot air drying of an ink or coating on a surface, comprising, a hot air dryer including a hot air chamber, a wall of said chamber including an opening, an ultraviolet curing unit located so that ultraviolet radiation emitted from said unit passes through said opening and onto a ink or coating on said surface when said ultraviolet curing unit is activated, a cover for said opening which is movable from a first position where it does not cover said opening when said curing unit is activated to a second position where it does cover said opening when said dryer is activated, and means for causing hot air to pass out of said chamber and onto an ink or coating on said surface when said hot air dryer is activated, wherein said cover comprises a slide plate which slides along the chamber wall.

3. An apparatus which is capable of performing either ultraviolet curing or hot air drying of an ink or coating on a surface, comprising, a hot air dryer including a hot air chamber, a wall of said chamber including an opening, an ultraviolet curing unit located so that ultraviolet radiation emitted from said unit passes through said opening and onto a ink or coating on said surface when said ultraviolet curing unit is activated, a cover for said opening which is movable from a first position where it does not cover said opening when said ultraviolet curing unit is activated to a second position where it does cover said opening when said hot air dryer is activated, said cover providing a required volume and pressure for operation of said hot air dryer, and means for causing hot air to pass out of said chamber and onto an ink or coating on said surface when said hot air dryer is activated.

4. The apparatus of claim 3 wherein said cover comprises a slide plate which slides along the chamber wall.

5. The apparatus of claim 4 wherein said slide plate is moved by an air cylinder.

6. The apparatus of claim 3 further including electrical means which permits activation of said ultraviolet curing unit when said cover is in said first position.

7. The apparatus of claim 3 wherein said hot air dryer has an openable and closeable door which is opened to gain access to said surface, further including electrical means which precludes activation of said ultraviolet curing unit when said door is open.

8. The apparatus of claim 3 wherein said ultraviolet curing unit is disposed over said chamber wall.

* * * * *